US010602817B2

(12) United States Patent
Price

(10) Patent No.: US 10,602,817 B2
(45) Date of Patent: Mar. 31, 2020

(54) UMBRELLA SYSTEM AND METHOD

(71) Applicant: Lance Price, Columbia, SC (US)

(72) Inventor: Lance Price, Columbia, SC (US)

( * ) Notice: Subject to any disclaimer, the term of this patent is extended or adjusted under 35 U.S.C. 154(b) by 0 days.

(21) Appl. No.: 16/104,623

(22) Filed: Aug. 17, 2018

(65) Prior Publication Data

US 2019/0053588 A1 Feb. 21, 2019

Related U.S. Application Data

(60) Provisional application No. 62/547,143, filed on Aug. 18, 2017.

(51) Int. Cl.
*A45B 23/00* (2006.01)
*A45B 25/00* (2006.01)

(52) U.S. Cl.
CPC ..... *A45B 23/00* (2013.01); *A45B 25/00* (2013.01); *A45B 2023/0012* (2013.01); *A45B 2025/003* (2013.01); *A45B 2200/1045* (2013.01); *A45B 2200/1054* (2013.01); *A45B 2200/1063* (2013.01)

(58) Field of Classification Search
CPC ..... A45B 2025/003; A45B 2200/1009; A45B 2200/1045; A45B 2200/1054; A45B 2200/1063
See application file for complete search history.

(56) References Cited

U.S. PATENT DOCUMENTS 2,643,843 A * 6/1953 Brown ..... E04H 12/2223 248/156
4,832,304 A * 5/1989 Morgulis ..... A01K 97/10 135/16
4,920,897 A 5/1990 Reed et al.
5,000,384 A * 3/1991 Arnold ..... A47C 1/14 165/48.2
5,046,699 A * 9/1991 Perreault ..... E04H 12/2223 135/16
5,152,495 A * 10/1992 Jacinto ..... E04H 12/2223 135/98
5,156,369 A 10/1992 Tizzoni
5,293,889 A * 3/1994 Hall ..... A45B 3/00 135/16
5,396,916 A 3/1995 Boissonnault
5,662,304 A * 9/1997 McDaniel ..... E04H 12/2223 248/499

(Continued)

*Primary Examiner* — David R Dunn
*Assistant Examiner* — Danielle Jackson
(74) *Attorney, Agent, or Firm* — Southeast IP Group, LLC; Thomas L. Moses

(57) ABSTRACT

An umbrella system includes a collapsible umbrella preferably having a telescoping pole, and including a generally hollow base unit with an auger member attached to a bottom portion thereof. The telescoping pole may be adjustable in height by any suitable means, and is received by the base unit having a pair of handle members extending radially therefrom, so that a user may grip the handle members in order to twist the base unit with the auger member into the ground. Other features may include an attachable table member, attachable drink holders, a removable carrying strap, a rotating collar assembly affixed to the lower portion of the base unit for attachment to a dog leash, and a water misting system for providing a spray water mist beneath the shade of the umbrella.

9 Claims, 9 Drawing Sheets

(56) References Cited

U.S. PATENT DOCUMENTS 6,199,569 B1 * 3/2001 Gibson ..... E04H 12/2223 135/16
6,443,172 B2 9/2002 Brumfield
6,487,977 B1 12/2002 Williams et al.
6,682,000 B1 * 1/2004 Apple ..... A45B 3/00 239/289
6,886,759 B1 * 5/2005 Okronick ..... A45B 3/00 239/16
7,007,703 B2 3/2006 Brooks, III
7,207,450 B1 * 4/2007 Franklin ..... A45F 3/44 108/25
7,353,775 B1 * 4/2008 Stelmach ..... A01K 1/04 119/61.54
7,497,225 B1 3/2009 Klein, Jr. et al.
7,503,541 B2 3/2009 Harold et al.
7,520,485 B1 4/2009 Giannetto
7,581,707 B2 9/2009 Saraf
7,950,200 B2 * 5/2011 Tropiano ..... E04H 12/2223 135/98
9,179,745 B2 11/2015 Berland
9,380,861 B1 * 7/2016 Newman ..... A47B 3/06
9,554,630 B1 * 1/2017 Patel ..... A45B 25/02
9,706,834 B1 * 7/2017 Taylor ..... A45B 23/00
2002/0078985 A1 * 6/2002 Farr ..... A45B 3/00 135/16
2006/0272687 A1 * 12/2006 Tanner ..... E04H 12/2223 135/16
2007/0246091 A1 * 10/2007 Becker ..... A45B 3/00 135/16
2008/0048051 A1 * 2/2008 Chang ..... A45B 3/00 239/289
2009/0090404 A1 * 4/2009 Kuelbs ..... A45B 3/00 135/16
2009/0236489 A1 * 9/2009 Gambill ..... A45B 23/00 248/539
2018/0106062 A1 * 4/2018 Brady ..... E04H 12/2215
2018/0168125 A1 * 6/2018 Johnson ..... A01K 1/04

* cited by examiner

UMBRELLA SYSTEM AND METHOD

CROSS REFERENCE TO RELATED APPLICATIONS

The present application is a utility conversion of U.S. Provisional Application Ser. No. 62/547,143, entitled Umbrella System and Method, filed on Aug. 18, 2017. All of the foregoing applications are hereby incorporated by reference in their entireties.

BACKGROUND OF THE INVENTION

In recent years, many types of umbrellas have been developed and commercialized for providing shade and shelter for people who are participating in outdoor activities, such as bird hunting, beach-going or tailgating for sporting events. Typically, these umbrella systems include a means for attaching the umbrella to the ground in such a way that it is stable in breezy conditions, and may include additional features, including attachable tables or seats.

Various efforts to develop umbrella and shade systems have been attempted previously, and examples of such systems are provided hereinbelow. Each of the references listed below are hereby incorporated herein by reference, in their entirety:

U.S. Pat. No. 4,920,897—Beach and Lawn Table with Umbrella Holder

A beach and lawn table which is affixed to the ground on which it rests by an auger projecting from the base of the table. The table has a single axially located leg which also provides a holder for the shaft of an umbrella. The table top is removably mounted on the upper end of the table's leg and also serves as a wrench to screw the auger into the ground until the base of the table rests firmly on the ground.

U.S. Pat. No. 5,156,369—Beach Umbrella

A ground anchoring arrangement for attachment to, for example, the pole of a beach umbrella or the like consists of a hollow cylindrical member having a rod rotatably supported therein. A spiral screw is attached to one end of the rod, and the other end of the rod is grippingly (CANC) attachable to a handle rotator. Thus, when the handle rotator is rotated, the rod rotates, and the spiral screw rotates with it. The point of the screw is placed adjacent to the ground and rotated so that the screw digs itself into the earth to firmly fix the elongated cylinder in the ground.

U.S. Pat. No. 5,396,916—Beach Umbrella Anchoring Device

A shading device including an umbrella-like canopy comprising a collapsible frame and a flexible light-proof covering with a anchoring device for supporting the shade device above ground so that the canopy will serve as a sun shade, particularly for blocking the rays of the sun wherein the anchoring device including an offset support arm for overhanging the canopy and a anchoring helix adapted to be driven into the ground for providing support to the shading device, said anchoring device is mounted to the other end of a crankshaft with a hand crank for rotating the crankshaft in screw fashion to drive the anchoring helix to impart rotational force to drive the helical member of the anchoring device into the ground for anchoring.

U.S. Pat. No. 6,443,172—Beach Umbrella with Self-Supporting Stand

A beach umbrella is supported with a stand having a lower shaft and an upper shaft, with the upper shaft supporting a beach umbrella mast. Before attaching the umbrella mast, the tubular upper shaft serves as an impact tool against a protuberance on the lower shaft, allowing hammering of the lower shaft into composite earth. The upper shaft telescopes onto the lower shaft securing a tray in place against the protuberance after hammering is completed.

U.S. Pat. No. 6,487,977—Beach/Outdoor Table with Cork Screw Anchor and Umbrella

A portable beach/outdoor table includes a table top adapted to be removably mounted onto the top end of a support pole. An auger is attached to and projects vertically from the lower end of the support pole. A diametrically-extending rod is attached to the support pole adjacent the auger. The rod functions as a wrench to aid in inserting the support pole into the ground. The rod also functions as a stabilizer for the table-mounted support pole.

U.S. Pat. No. 7,007,703—Umbrella with an Integral Anchoring Structure

An umbrella with an integral anchoring structure is provided. The umbrella includes a post having a lower end for insertion into the ground, and an upper end for supporting an umbrella top. The umbrella includes an integral spiral shaped anchoring structure formed on the lower end of the post. The anchoring structure is formed with a width, W, greater than a diameter of the post and a length, which is adapted to stabilize a weight of the umbrella and secure the umbrella and the post in a variety of earthen conditions such as sand, lawn, and soil even in a prevailing breeze or stormier conditions. The umbrella further includes one or more retractable levers integrally attached along the post.

U.S. Pat. No. 7,497,225—Multi-Functional Umbrella

A multi-functional umbrella includes a first rod and a collapsible canopy directly anchored thereto. A second rod is pivotally attached to the first rod, and a handle section is monolithically formed with the second rod and spaced from the first rod. A mechanism automatically penetrate the second rod beneath a ground surface. A mechanism broadcasts audio signals and is housed within the second rod and the handle section, and includes a radio and a speaker electrically coupled thereto. A mechanism discharges a predetermined quantity of fluid from the first rod. The automatic penetrating mechanism and the broadcasting mechanism and the fluid discharging mechanism are simultaneously and independently operable as desired by the user.

U.S. Pat. No. 7,503,541—Beach Umbrella Stand Including Foot Operated Drive Assembly for Anchoring and Method of Use A beach umbrella stand is provided including a foot operated drive assembly. A pole of a beach umbrella stand has a hollow interior portion housing the foot operated drive assembly. The foot operated drive assembly includes a ratchet assembly operated by a foot pedal. The ratchet assembly further includes an auger mounted at least partially within the pole, for driving into the sand. The ratchet assembly is positioned for operation of a pedal by a user's foot.

U.S. Pat. No. 7,520,485—Multi-Mode Beach Umbrella Anchor

A multi-purpose beach anchor provides a sturdy base for at least one of a small, medium or large sized beach umbrella as well as for an optional table and an optional tubular holder for a fishing rod. The rigidity of the anchor is secured by an integral hand operable slide hammer mechanism for driving the spike element into the sand for an optimal distance straight down. This slide hammer is used by sliding up and down over a tubular support member atop the spike, wherein the spike has an integral strike collar. A few short strokes of the weighted slide hammer element drives the spike into the sand or other terrain. A hand screw is then used to lock the hammer weight to the tubular support and the spike rigidly. An umbrella shaft can then be directly slid over the support tube and locked in place.

U.S. Pat. No. 7,581,707—Automatic Universal Multi-Purpose Ground Stand

An automatic, universal, multi-purpose ground stand to securely affix an umbrella, or any like device, into any malleable surface such as sand, grass, gravel or dirt. The device is intended to accommodate any size or shape of commercially available beach or sun umbrellas. This device also contemplates the securement of other devices such as fishing poles. The device is comprised, primarily of a main tube with a helical auger screw bit and a DC electric motor to turn the screw. A user of said device would extend the helical auger screw bit, engage the DC electric motor, and allow the action of the DC electric motor to secure the helical auger screw into a malleable surface.

U.S. Pat. No. 9,179,745—Awesumbrella

An improved self-anchoring umbrella, the umbrella comprising a canopy and pole, a retractable auger disposed within the pole of the umbrella. The retractable auger is operated using an electric motor and portable power source, and a switch allowing a user to provide power to the electric motor which rotates a drive head with spiral teeth engaged within spiral grooves in the pole. The umbrella may further include a table portion, and extendable stabilizing legs disposed in the lower portion of the pole. When the auger portion is screwed into sand or other surface and the stabilizing legs are engaged with the surface, the invention provides a stable umbrella for outdoor recreation and other purposes.

BRIEF SUMMARY OF THE INVENTION

In accordance with one aspect of the invention, a first embodiment of an umbrella system includes a collapsible umbrella having a telescoping pole, and including a generally hollow base unit with an auger member attached to a bottom portion thereof. The telescoping pole may be adjustable in height by any suitable means, and is received by the base unit having a pair of handle members extending radially therefrom, so that a user may grip the handle members order to twist the base unit with the auger member into the ground.

Other features may include an attachable table member, attachable drink holders, a removable carrying strap, a rotating collar affixed to the lower portion of the base unit for attachment to a dog leash, attachable fishing rod holders, attachable dog food or water bowls or containers, and a water misting system for providing a spray water mist beneath the shade of the umbrella. In a preferred embodiment, the umbrella system is collapsible and capable of disassembly, so that all of the components may be stored in a small bag for storage and transport, and set up as desired.

In another embodiment, the base unit may include a motor-driven mechanism for turning the auger, so that a user may simply place the auger on any desired spot on the ground and turn on the motor driven mechanism to drive the auger member into the ground.

BRIEF DESCRIPTION OF THE DRAWINGS

These and other features, aspects, and advantages of the present invention will become better understood with regard to the following description, appended claims, and accompanying drawings where:

FIG. 1 is a perspective view of one embodiment of an umbrella system in accordance with the present invention, including a collapsible umbrella, a pole supporting the umbrella, a hollow base unit including an auger member at the bottom portion thereof, a pair of handle members extending radially from the base unit, an attachable table removably affixed about the base unit and supported by the handle members, the table having openings on an upper surface for holding various items, and a rotating collar positioned about a lower portion of the base unit with attachment means for receiving one end of a dog leash or the like;

FIG. 3 is a perspective exploded view of one embodiment of the base member of an umbrella system in accordance with the present invention, showing a base member having an auger at a lower end thereof, a removable table that is attachable to the base unit, a pair of handle members, a knob that tightens down on an umbrella pole when placed into the base unit, and a ring and eyelet disposed about the base member for attaching a dog leash or the like;

DETAILED DESCRIPTION OF THE INVENTION

Overview

Figure 1:
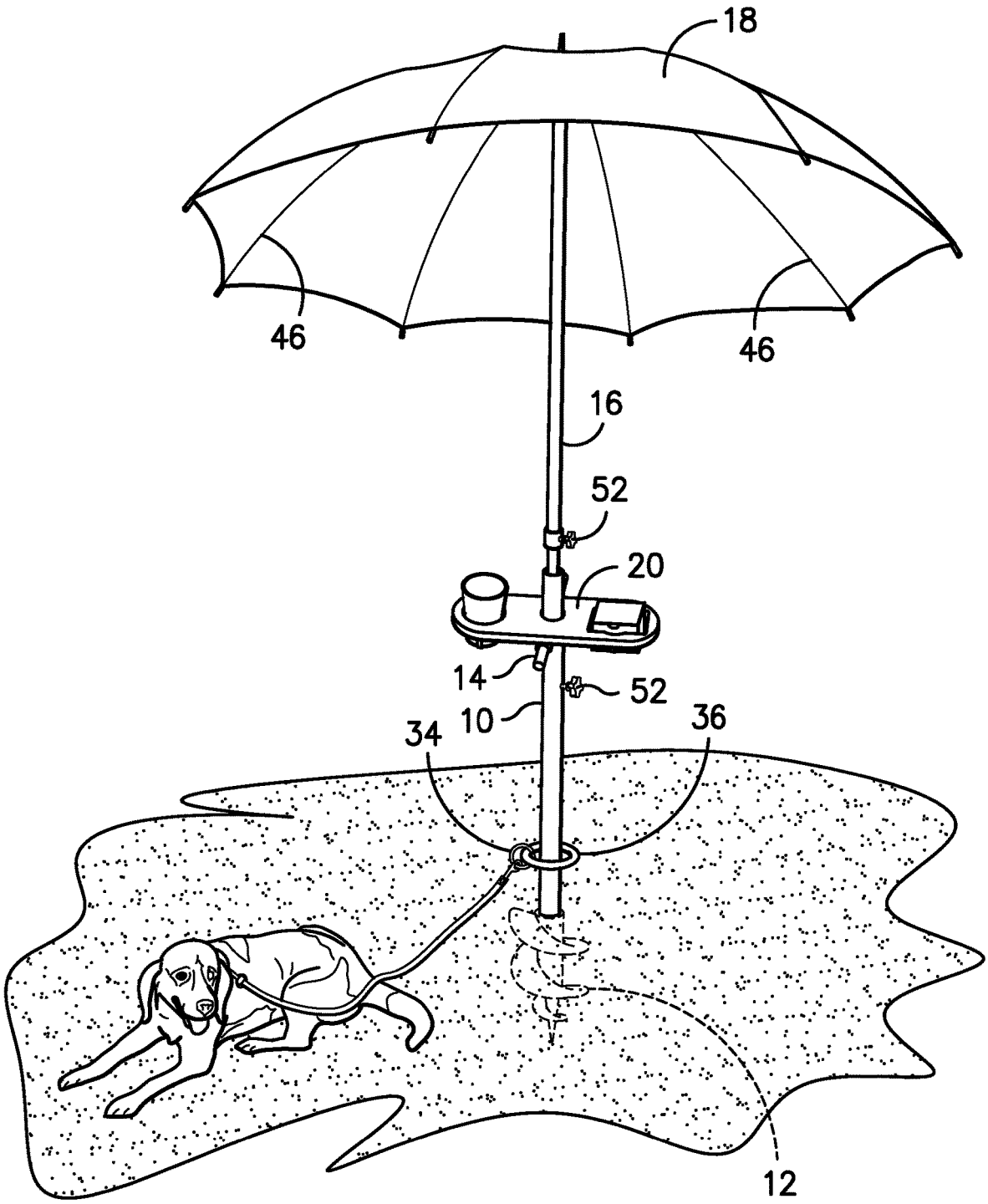
Figure 2:
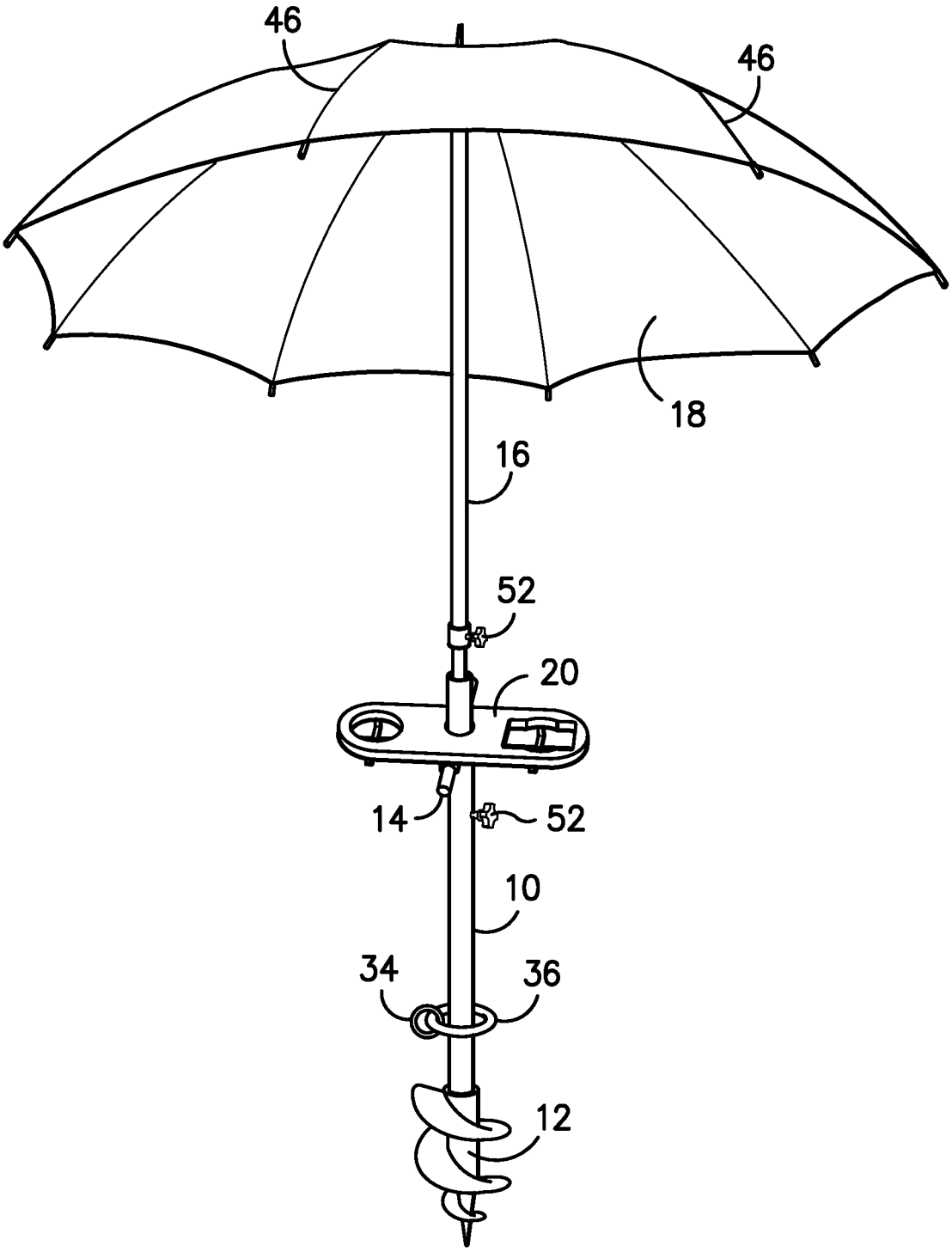
FIG. 2 is a perspective view of one embodiment of an umbrella system in accordance with the present invention.

The present invention includes, in a first embodiment, a base unit 10 comprising a hollow tube having an auger member 12 attached (either as a separate component, or integrally formed) to a bottom portion thereof. A handle member 14 is disposed near the top of the base unit 10, and preferably comprises a pair of handles 14 extending radially from opposed sides of the base unit 10, to allow a user to grasp the handles and turn the base unit 10 so that the auger member 12 drives the base unit 10 securely into the ground. The base unit 10 is preferably hollow, and includes a hole at a top end for receiving the umbrella pole 16. A knob 52 may include a threaded portion that engages a threaded hole on a side of the base member 10, and may be used to secure the umbrella pole in place within the base member 10. The umbrella pole may be raised or lowered within the base member, and the knob 52 is used to secure the umbrella pole at any desired position, which allows the height of the umbrella to be adjusted. The umbrella 18 is preferably collapsible, consistent with traditional style umbrellas, and the pole 16 supporting the umbrella may be arranged in a telescopic fashion and secured with another threaded knob 52, thereby providing an additional height adjustment for the umbrella 18, as desired.

Figure 7:
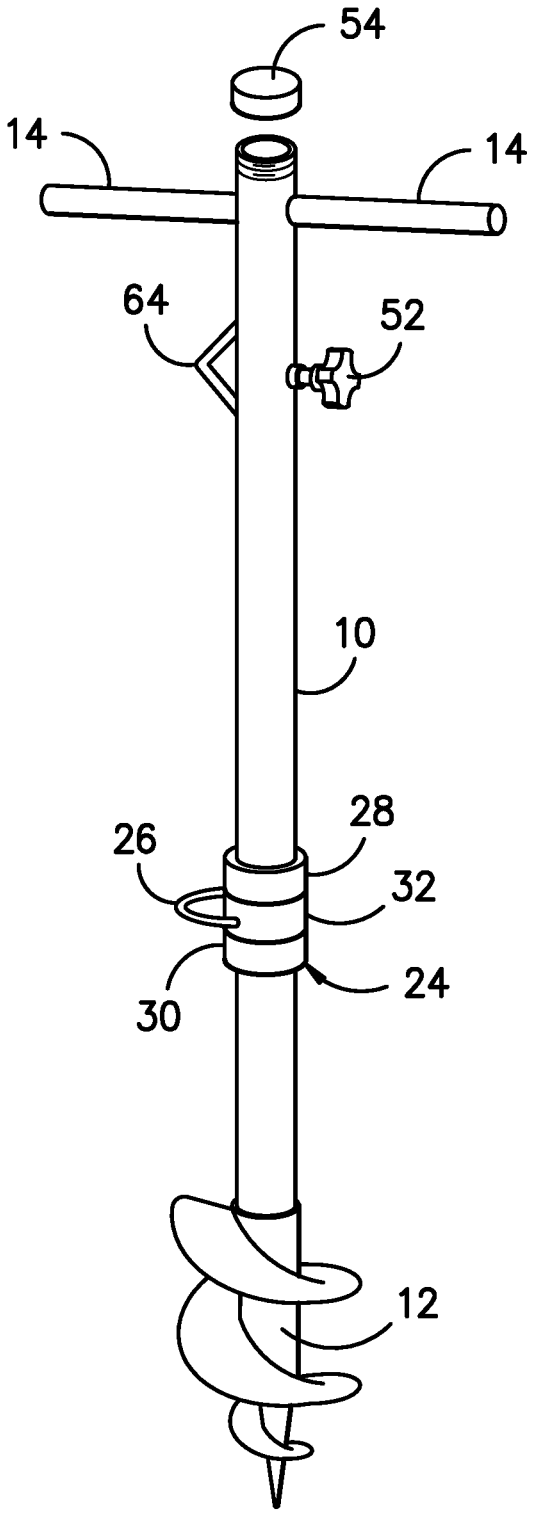
FIG. 7 is a perspective view of one embodiment of a hollow base member in accordance with one aspect of the present invention showing a cap member that may be screwed onto a top portion of the base member, so that the hollow portion of the base member may be filled with water, and the cap may be secured to the opening at the top of the base member in order to maintain the water within the hollow base member.

In one embodiment, the base member 10 is hollow, and may be filled with water during transport to a desired location, in order to provide water for a dog bowl, for example. In this embodiment, a user may fill the base member 10 with water, and then may place a cap 54 over the opening at the top portion of the base member to prevent the water from spilling out of the base her, as shown in FIG. 7. When the user arrives at a desired location to set up the umbrella assembly, the user may remove the cap 54 and pour the water from the hollow base member 10 into a dog bowl. This arrangement obviates the need to carry an extra water container for a dog.

Figure 3:
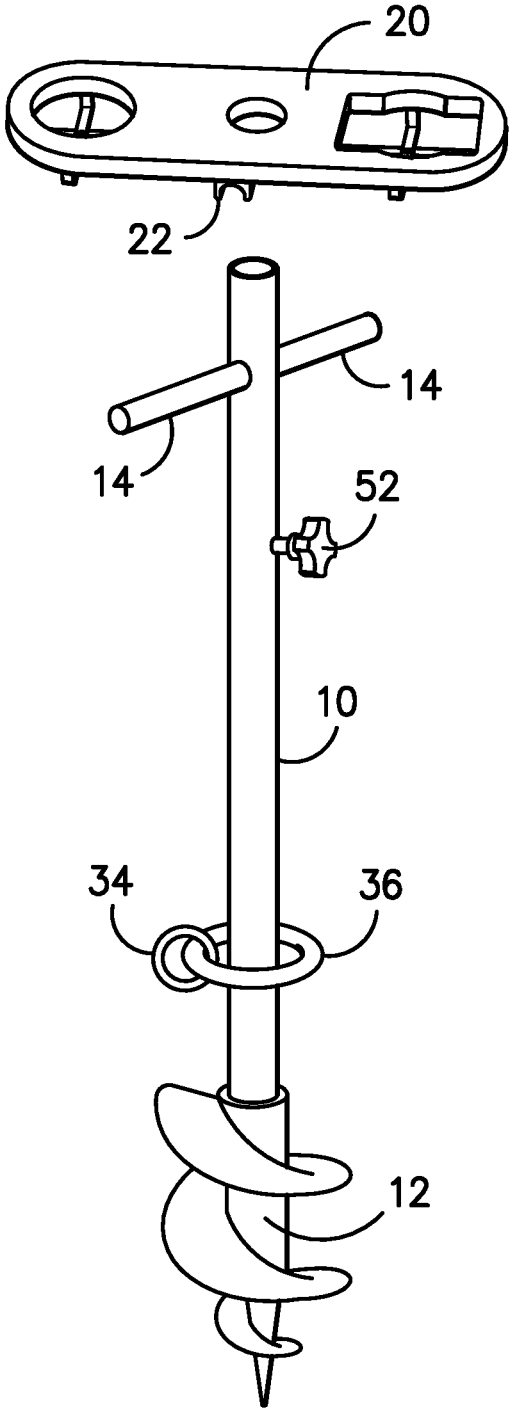
Figure 4:
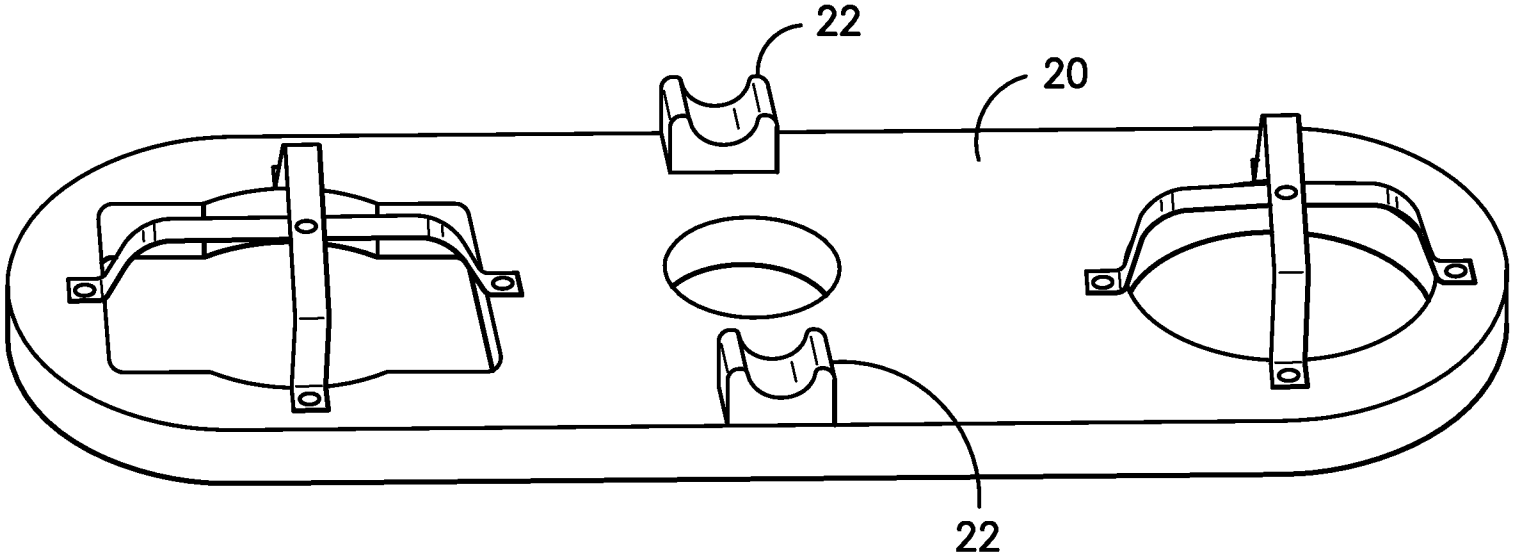
FIG. 4 is a perspective underside view of a removable table that is attachable to the base unit of the umbrella system in accordance with one embodiment of the present invention, wherein the table includes a pair of holes on either side, one generally square shaped hole and one round hole, and further including a pair of cross-straps that extend beneath the holes in the table for supporting items placed within the holes, and a pair of snap-fit members that are used to secure the table to the handle members of the base member.
Figure 8:
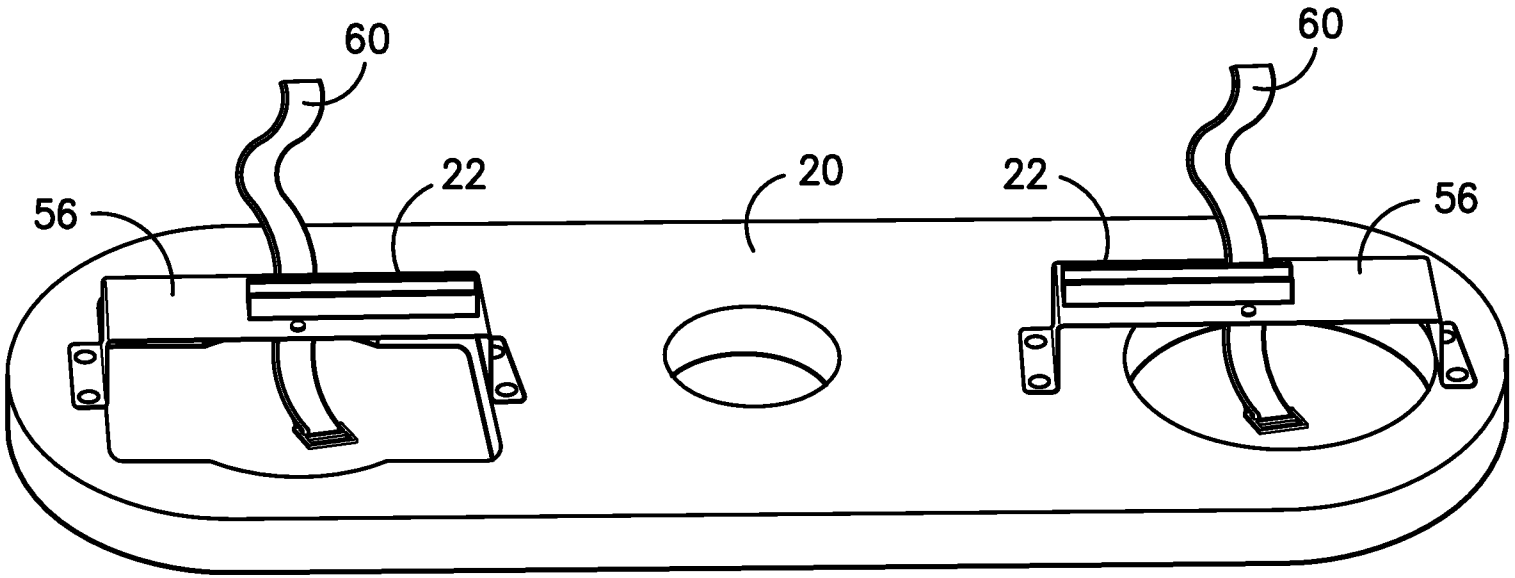
FIG. 8 is a perspective underside view of one embodiment of a removable table that is attachable to the base unit of the umbrella system in accordance with one embodiment of the present invention, wherein the table includes a pair of holes on either side, one generally square shaped hole and one round hole, and further including generally rigid support members disposed beneath the holes in the table for supporting items placed within the holes, straps attached to the support members for holding a bag or the like, and a pair of snap-fit clips attached to the underside of the support members, wherein the snap-fit clips that are used to removably secure the table to the handle members of the base member.
Figure 9:
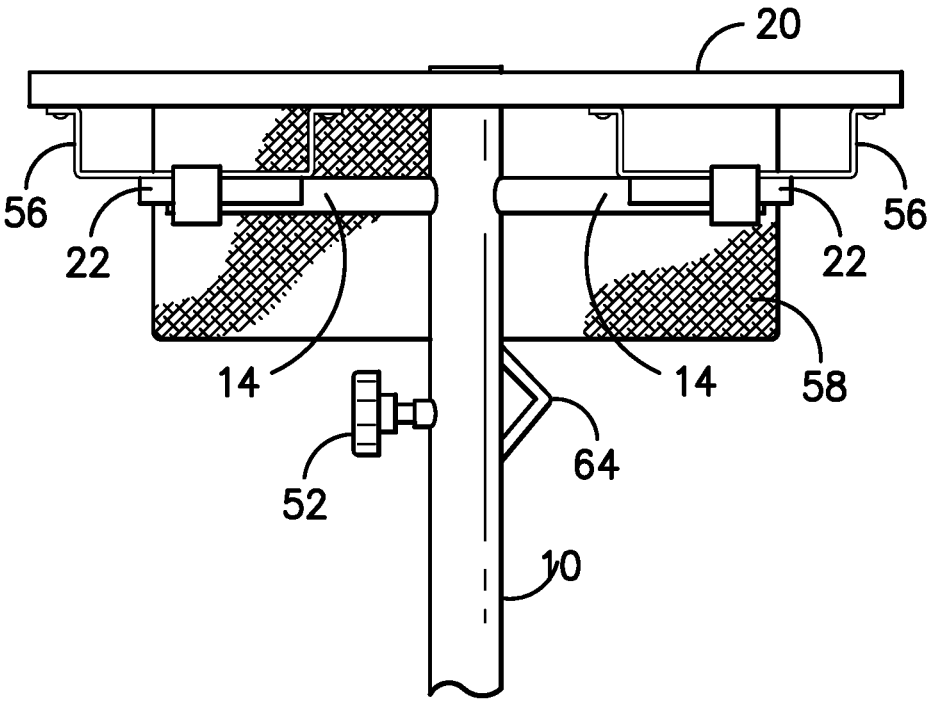
FIG. 9 is a partial rear side view of a one embodiment of a removable table attached to the base member, wherein snap-fit clips are engaged with the handle members, and further showing a bag attached to the table member for holding or storing items.
Figure 10:
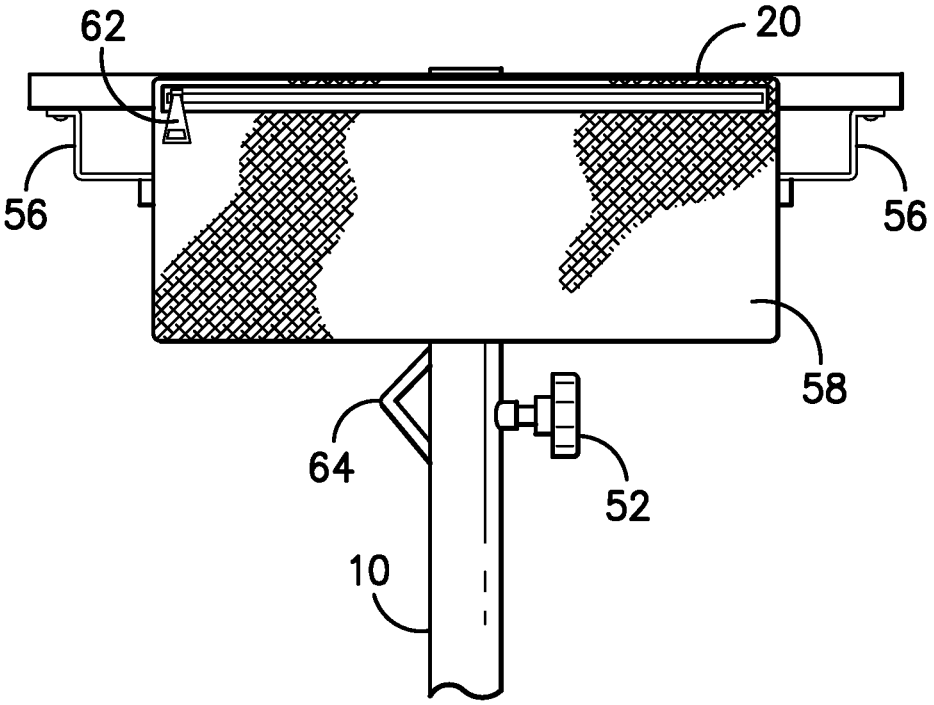
FIG. 10 is a partial front side view of the embodiment shown in FIG. 9.

Optionally, a removable table member 20 may fit over the top of the base unit 10, as shown in FIGS. 1-6. The table member 20 includes a central hole, which allows the table 20 to slide onto the top of the base unit 10 until it rests on the handle members 14, as shown. The handle members 14 may be used to support the table member 20, and in one embodiment, the table member 20 may include clips or snap fit attachments 22 on an underside thereof, as shown in FIGS. 3 and 4, where the clips 22 may snap-fit onto the handle members 14 so that the table member 20 is removably secured to the top portion of the base unit 10. The table may also include additional holes or openings for receiving drinks, cups, ammunition boxes, or the like, which are supported on an underside by straps or other flexible or rigid support surfaces below the openings, as shown in FIGS. 8-10.

Optionally, a storage bag 58 may be removably attached to the table member 20 by any suitable means, including straps 60, clips, hook and loop fasteners, or the like. The bag preferably has an opening at an upper portion thereof, with a zipper 62 or other mechanism that closes the opening. Any suitable closing mechanism may be used, including hook and loop material, snaps, or other commonly used closing mechanisms. In one embodiment, the bag straps 60 are attached (either permanently secured, or removably attached) to the rigid support surfaces disposed beneath the holes in the table member, as shown in FIGS. 8-10.

Rotating Collar Assembly

A rotating collar assembly 24 may be attached to a lower portion of the base unit 10. In one embodiment, the rotating collar comprises an outer sleeve 26 having a top portion 28 and a bottom portion 30 that holds an inner tube 32 in place on the base unit 10, so that the inner tube 32 may rotate about the longitudinal axis of the base unit 10, as shown in FIG. 7. The inner tube 32 further includes an eyelet 34 that may rotate with the inner tube 32, where the eyelet 34 protrudes between the top portion 28 and the bottom portion 30 of the outer sleeve 26, as shown. This arrangement allows a dog leash to be attached to the rotating collar assembly 24 so that the dog may roam about the periphery of the base unit 10 without twisting the leash about the base unit. FIG. 7 also shows an attachment point 64 below the handle members for attachment of a carrying strap. The strap may be attached at the attachment point on one end of the strap, and may attach at the other end to the rotating collar assembly 24, so that a user may carry the disassembled umbrella system using the strap.

The rotating collar assembly 24, in another embodiment, includes a circular track having ballbearings secured within the track, and a rotating disc fits into the track and rotates about the track over the ballbearings. The rotating collar may include an eyelet 34 extending radially therefrom, so that a dog leash may be clipped onto the eyelet 34. Alternatively, a ring 36 may simply be placed around the base member 10.

Misting System

Figure 6:
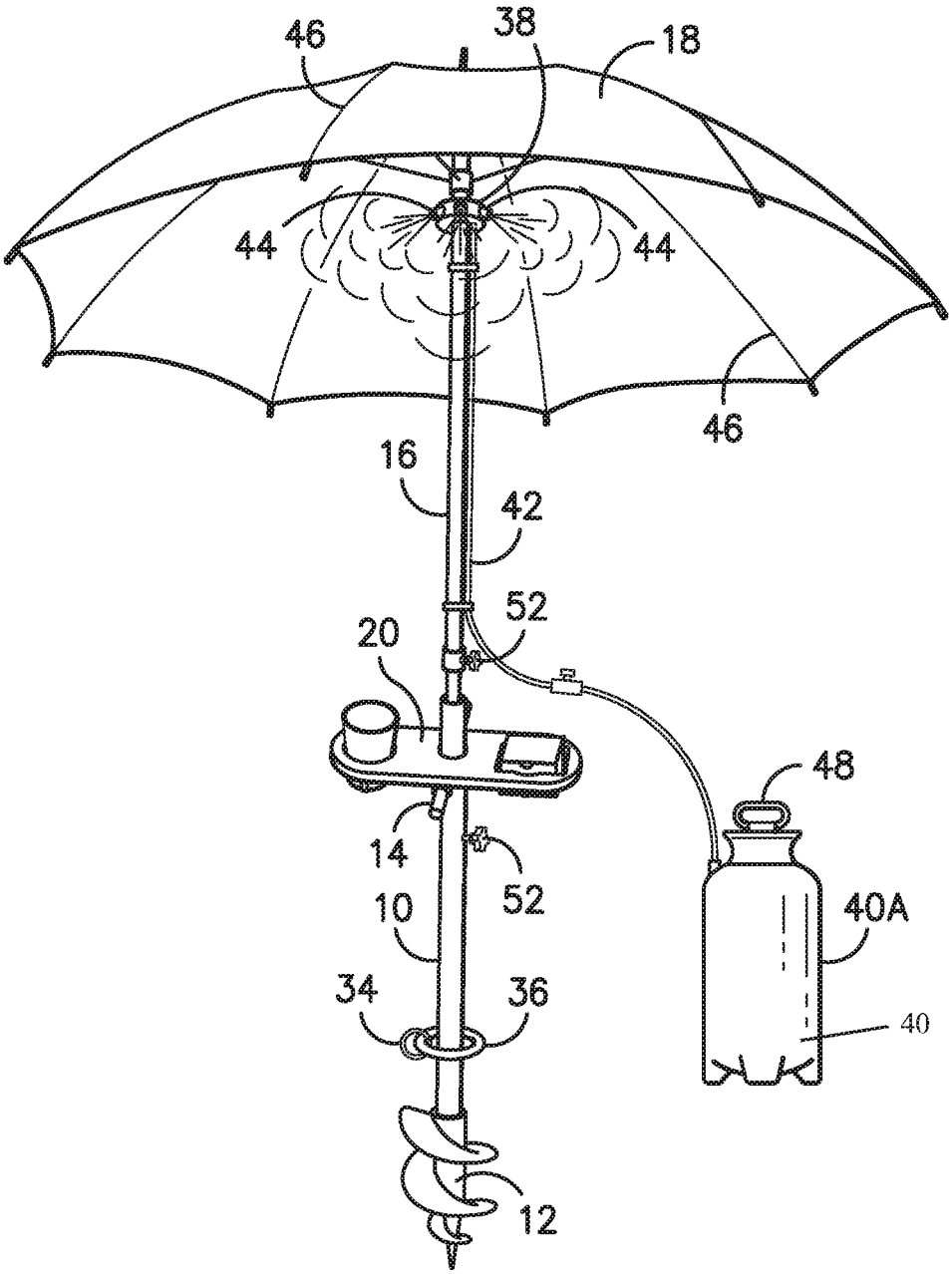
FIG. 6 is a perspective view of an umbrella system in accordance with the present invention, further including a misting system including a manual pump water container having a water hose attached thereto, wherein the hose runs upwardly to a top portion of the umbrella pole and is connected to a series of misting valves, and wherein the manual pump is used to create pressure for pumping water from the water container to the misting valves.

In one preferred embodiment, a misting system 38 is provided. The misting system 38 includes a water container 40 and a water hose 42 that extends upwardly along (inside or outside of) the base unit 10 and the umbrella pole 16 to one or more misting valves 44 that are attached to the underside of the umbrella 18, preferably either to the underside of the umbrella spokes 46, or to the umbrella pole 16, or both. In one embodiment, the water container 40 comprises a spray bottle 40A having a hose 42 and a hand pump 48 for pressurizing the container, so that a user may simply use the hand pump 48 to pressurize the spray bottle 40A, which forces water through the hose 42 to the misting valves 44, as shown in FIG. 6. When the water is pumped from the spray bottle 40A, through the spray bottle hose 42 and then through the misting system hose 42 to the misting valves 44, a mist is emitted from the misting valves 44, which provides a cooling effect to users who are positioned underneath, or near the umbrella 18. It should be understood that the misting system 38 may be attached to the umbrella system in any suitable manner, and may be either built-in or completely detachable from the umbrella system and the base unit 10.

In one embodiment, the misting system 38 includes a hose 42 or tube that is disposed on the inner portion of the hollow base member 10, and includes an attachment mechanism connected to a bottom portion of the base member 10. The attachment mechanism may be attached to a hose extending from a manual pump spray bottle 40A (typically used for spraying insecticides, water, or other liquids for agricultural or landscaping purposes), and the upper portion of the misting system hose 42 may be attached to a single or multiple misting valves 44.

Figure 5:
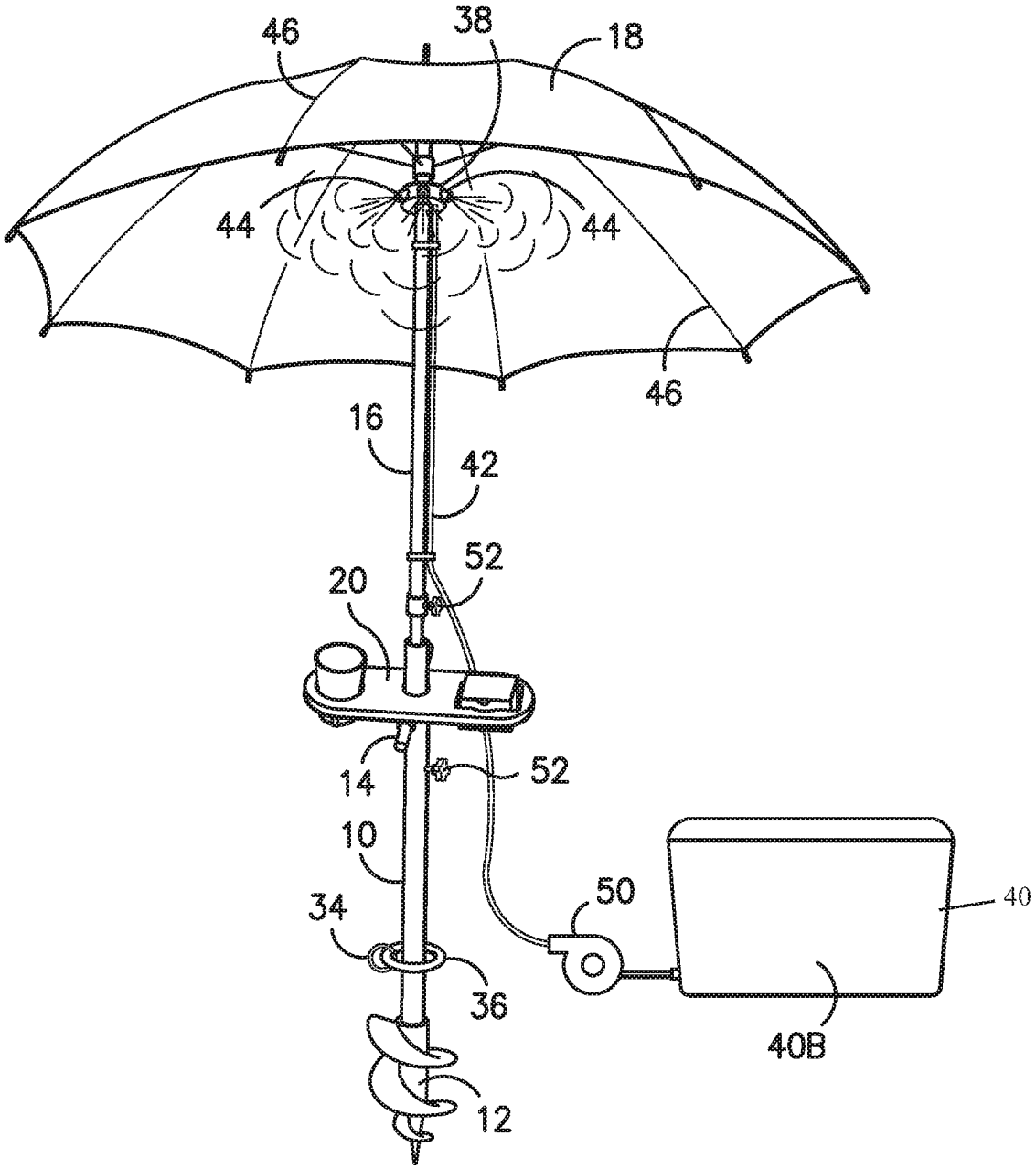
FIG. 5 is a perspective view of an umbrella system in accordance with the present invention, further including a misting system including a cooler having a water hose attached to a drainage valve, wherein the hose runs upwardly to a top portion of the umbrella pole and is connected to a series of misting valves, and further including a motorized pump disposed in-line along the water hose for pumping water from the cooler to the misting valves.

Alternatively, a motorized pump 50 may be used to pump water from any water container 40 or water source to the misting valves 44. The motorized pump 50 may take the form of an aquarium style pump or bilge pump that sits submerged in the bottom of a cooler 40B or other water container, or may be positioned in-line on the hose 42 as shown in FIG. 5, and is preferably battery operated. In another embodiment, the pump 50 may be attached to the base unit 10 itself, and may include an external intake hose 42 that may be placed into any water source, including a cooler 40B, a bucket, a pond, or may be attached to a spigot or water hose from an irrigation system, or the like. In FIG. 5, the water hose 42 is attached to the drainage valve of a cooler 40B, and runs to the motorized pump 50, which pumps the water upwardly to the misting valves 44. This arrangement is particularly useful, as the cooler 40B may further include ice, which keeps the water cold and provides additional relief as cold mist.

Motorized Auger

The base unit 10 may optionally include a motor for rotating the auger member, similarly to the operation of a drill. Preferably, the motor is mounted on the base unit 10, and may rotate the auger 12 in either direction, for inserting the auger 12 into the ground or for removing it from the ground. Alternatively, the base unit 10 may include the gearing mechanism for spinning the auger 12 in either direction, and the base unit 10 may include an attachment for receiving the rotating end of a hand-held drill. In this way, a user may place the base unit 10 at a desired location, attach the drill (or a complementary drill bit that fits the rotating attachment on the base unit) to the rotating attachment on the base unit, so that the operation of the drill spins the auger 12 in the desired direction. In another alternative, a hand crank may be used to spin the auger mechanism 12, instead of a motorized drill.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An umbrella system comprising:

a hollow base member having a sealed bottom and an auger member at a bottom end thereof and a hole at a top portion thereof for receiving an umbrella pole;

a collapsible umbrella having an umbrella pole that is received through said hole at said top portion of said base member;

a pair of straight handle members extending radially and horizontally from opposed sides of said base member in linear fashion;

a removable table member that rests on an upper portion of said handle members; and a cap member that may be removably secured to a top portion of said hollow base member, so that said base member may be filled with water and secured therein by said cap.

2. The umbrella system set forth in claim 1, further including a knob having a threaded portion that engages a threaded hole in a side of said base member, wherein said knob may be tightened against said umbrella pole when said umbrella pole is disposed within said hollow base member.

3. The umbrella system set forth in claim 1, further including a misting system attached to said umbrella, wherein said misting system includes a water container, a hose connected at one end to a said water container, and a pump for pumping said water through said hose to at least one misting valve disposed on an upper portion of said umbrella.

4. The umbrella system set forth in claim 3, wherein said pump is selected from the group consisting of a motorized pump or a manual pump.

5. The umbrella system set forth in claim 3, wherein said water container is a cooler.

6. The umbrella system set forth in claim 1, further including a rotating collar assembly disposed on said base member, said rotating collar assembly including an eyelet attached thereto, so that said eyelet rotates about a longitudinal axis of said base member, and wherein said eyelet is adapted to be connected to one end of a dog leash.

7. The umbrella system set forth in claim 6, further including an attachment point disposed on a side of said base member for attaching a strap thereto.

8. The umbrella system set forth in claim 1, further including a ring disposed about said base member for attachment to one end of a dog leash.

9. The umbrella system set forth in claim 1, further including a storage bag removably attached to said table member for storing items.

* * * * *